US007464494B2

(12) United States Patent
Bodinet

(10) Patent No.: US 7,464,494 B2
(45) Date of Patent: Dec. 16, 2008

(54) MAGNETIC CARD DISPLAY APPARATUS

(76) Inventor: Janice Bodinet, 8129 W. 129th St., Palos Park, IL (US) 60464

( * ) Notice: Subject to any disclaimer, the term of this patent is extended or adjusted under 35 U.S.C. 154(b) by 187 days.

(21) Appl. No.: 11/483,364

(22) Filed: Jul. 10, 2006

(65) Prior Publication Data

US 2006/0248765 A1 Nov. 9, 2006

Related U.S. Application Data

(63) Continuation-in-part of application No. 11/350,173, filed on Feb. 8, 2006, now abandoned.

(60) Provisional application No. 60/651,921, filed on Feb. 11, 2005.

(51) Int. Cl.
*G09F 7/00* (2006.01)

(52) U.S. Cl. ..... 40/611.01; 40/711; 40/754

(58) Field of Classification Search ..... 40/661.01, 40/600, 700, 711, 754, 755, 606.18, 611.01
See application file for complete search history.

(56) References Cited

U.S. PATENT DOCUMENTS 3,456,373 A * 7/1969 Epton ..... 40/124
3,928,921 A * 12/1975 Gurman ..... 434/428
5,384,999 A * 1/1995 Roche et al. ..... 52/764
5,495,686 A * 3/1996 Millard et al. ..... 40/621
5,784,817 A * 7/1998 Behme ..... 40/748
6,338,216 B1 * 1/2002 Young ..... 40/745
6,775,935 B1 * 8/2004 Cohen et al. ..... 40/600
2003/0041488 A1 * 3/2003 Wu ..... 40/1.6
2003/0121127 A1 * 7/2003 Walker ..... 24/306
2004/0003520 A1 * 1/2004 Trew ..... 40/124.01

* cited by examiner

*Primary Examiner*—Gary C Hoge

(57) ABSTRACT

A magnetic display apparatus includes a magnetic board unit which includes a non-magnetic board base and a magnet attracting layer attached to the non-magnetic board base. The magnet attracting layer can be either magnetic or ferro-magnetic material. Magnetic clamp units, having a non-magnetic handle and a magnetic base, are provided for attaching non-magnetic articles to the magnetic board unit. A decorative layer can be attached to the magnetic layer. The magnetic board unit can have an overall decorative shape. A removable and replaceable decoration can be provided, and decoration attachment means can be provided for attaching the removable and replaceable decoration to the magnetic board unit. A stand can be provided for supporting the magnetic board unit. The stand can provide that the magnetic board unit is sloped backward when placed in the stand. A slip over cover having a decorative theme can be provided for slipping over the magnetic board unit.

10 Claims, 8 Drawing Sheets

FIG 3
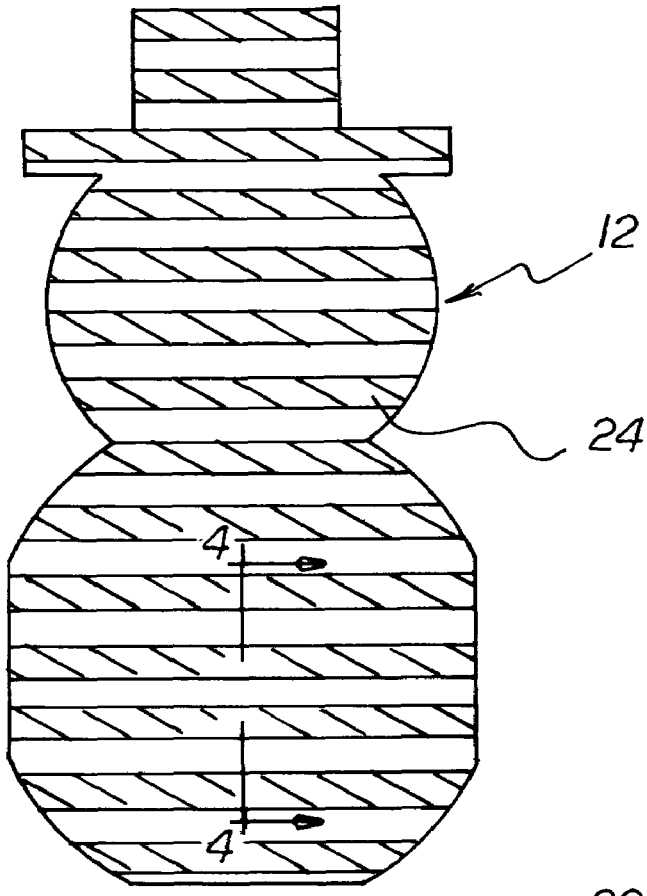
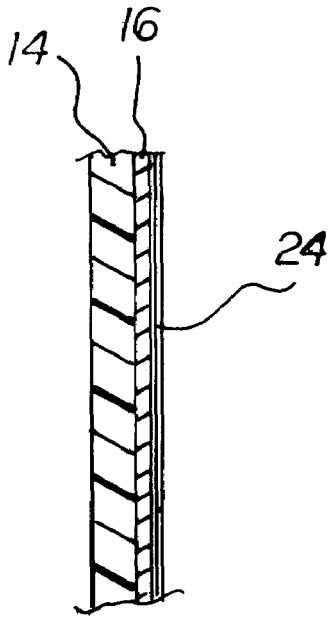
FIG 4
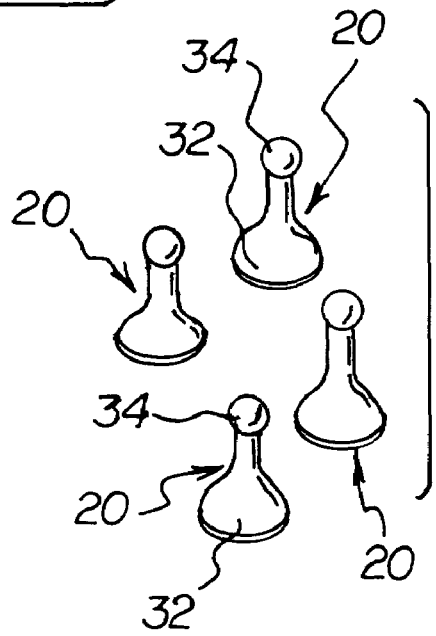
FIG 5

FIG 6
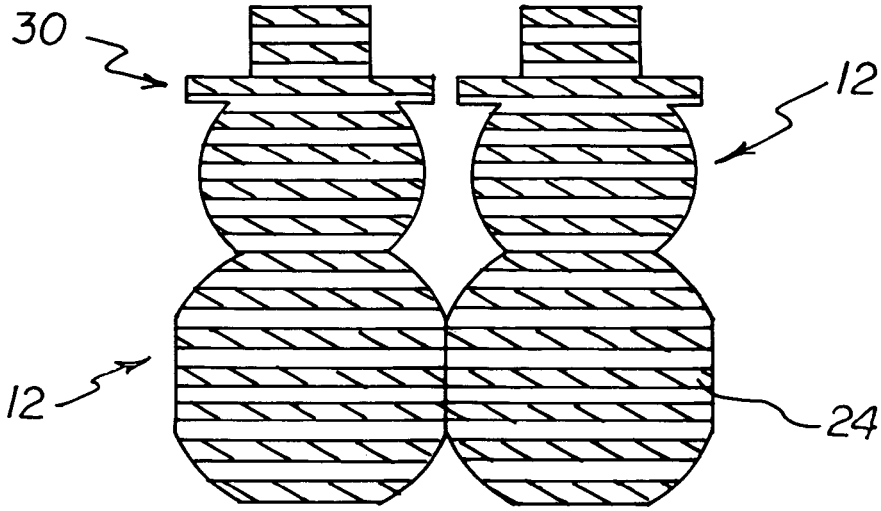
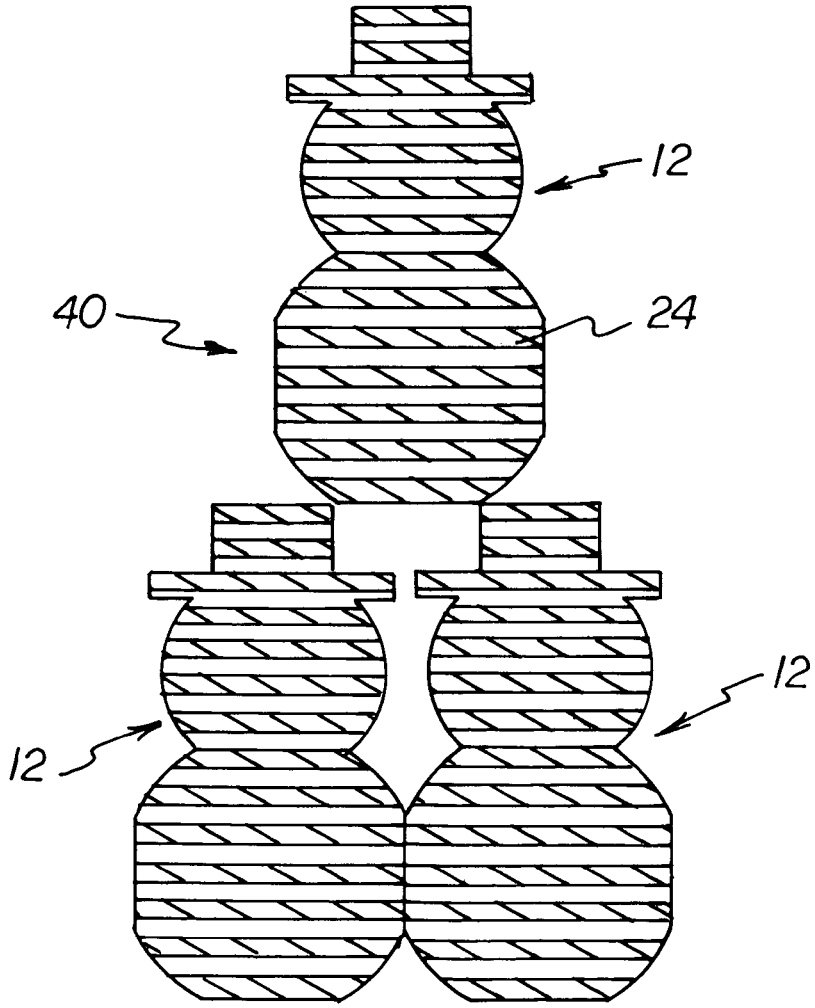
FIG 7

FIG 10
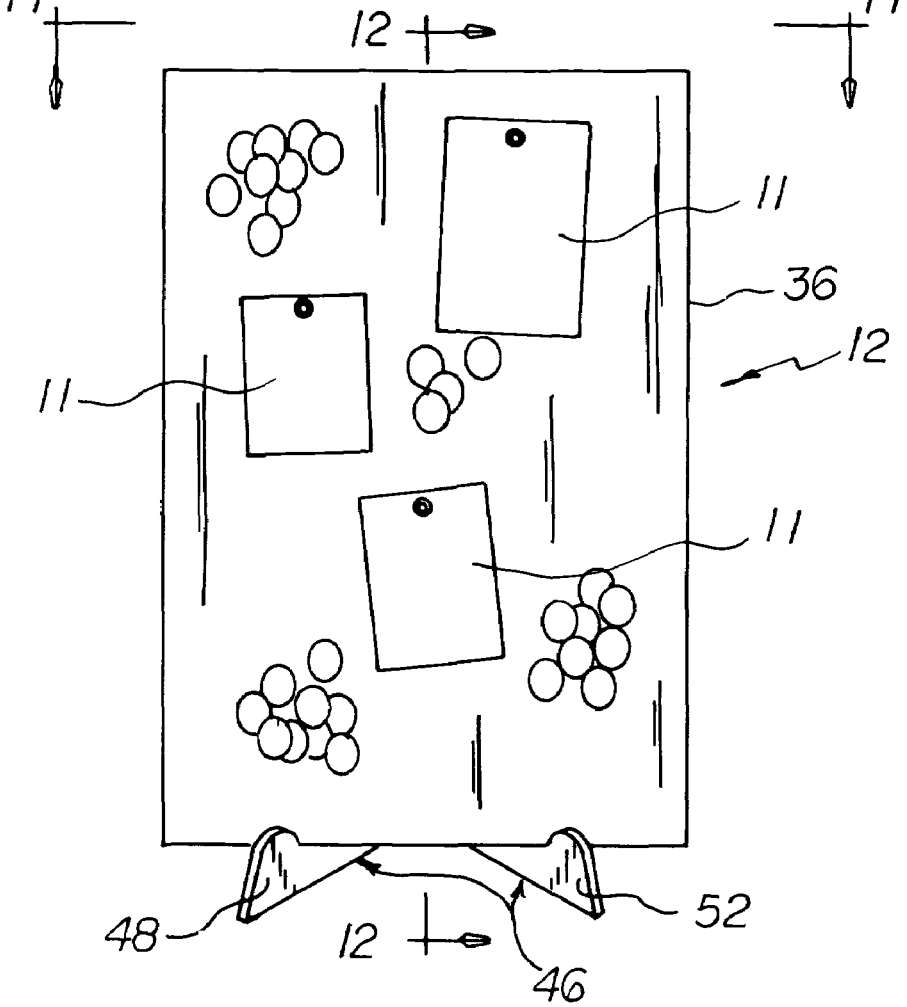
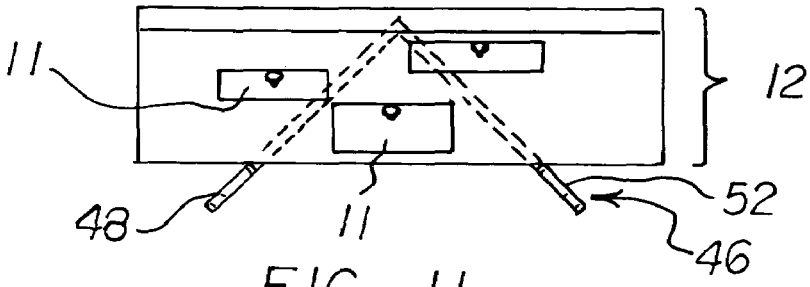
FIG 11

MAGNETIC CARD DISPLAY APPARATUS

CROSS-REFERENCE TO RELATED APPLICATION

This application is a Continuation-In-Part of my copending Non-Provisional application Ser. No. 11/350,173; filed Feb. 8, 2006, which in turn, claims priority based upon my copending Provisional Application Ser. No. 60/651,921; filed Feb. 11, 2005.

BACKGROUND OF THE INVENTION

1. Field of the Invention

The present invention relates generally to display devices for cards, photographs, and the like, and, more particularly, to display devices that employ magnetic elements for attaching a displayed article to the display device.

2. Description of the Prior Art

Devices that are used to display cards, photographs, and the like are well known in the art. In this respect, throughout the years, a number of innovations have been developed relating to such display devices, and the following U.S. patents are representative of some of those innovations: U.S. Pat. Nos. 4,979,901, 5,303,489, 5,377,820, and 5,994,990.

More specifically, U.S. Pat. No. 4,979,901 discloses a device for planning and controlling a diet and displaying items related thereto. With this device, individual cards are retained on the device in pockets. Also, the device itself is supported on a vertical surface by hooks and eyes. Alternatively, magnets can be used for supporting the whole device on a metal surface, such as a refrigerator. Rather than having cards retained on a vertically oriented device with pockets, it would be desirable if a card holding device were provided that retained the cards on the device with magnets.

U.S. Pat. No. 5,303,489 discloses a combined magnetic picture frame and gift/display card. The gift card or photograph is framed by a frame member which magnetically attached to a supporting surface. With this device, the frame and the card or photograph must be congruent with each other for the frame to fit properly around the card or photograph. Rather than being constrained by a congruency between a frame and a card or photograph, it would be desirable if a card or photograph holding device were provided that does not require a magnetic frame to fit properly around a card or photograph. More specifically, it would be desirable if a magnetic device were provided to attach a card or photograph to a complementary magnetic support that does not require a magnetic frame to be employed at all.

U.S. Pat. No. 5,377,820 discloses a magnetic display assembly for displaying and carrying articles, such as earrings, on a bracket which is held by magnetic force to a magnetic support structure. The portion of the earring-holding bracket which directly carries and supports the earrings is spaced apart from another portion of the bracket which includes a magnetic strip which attaches to the magnetic support surface. More specifically, each bracket has three right-angled bends to provide the spacing away from the magnetic support surface. However, in many instances, there is no need for a magnetic bracket to be provided for holding three-dimensional articles, such as earrings, in a spaced relation away from the support surface. In this respect, there is no need for an article-holding portion to require three right-angled bends to space the portion away from the magnetic support surface.

U.S. Pat. No. 5,994,990 discloses a magnet sheet for display of printed sheets that are bonded to the top surface of the magnet sheet. In this respect, the printed sheets that are displayed are permanently bonded to the underlying magnet sheet. With this permanent bonding of the printed sheet to the magnet sheet, the use of cards or photographs that can be interchanged with other cards or photographs on a magnet support is not possible. In this respect, it would be desirable if a magnetic card display device were provided that easily permits interchange or substitution of cards or photographs that are displayed on a magnetic support with other cards or photographs to be displayed on the magnetic support.

In addition, U.S. Pat. No. 5,662,326 is of interest for its disclosure of a chess set which includes magnetic chess pieces for attaching to a chess board. The magnetic chess pieces are attached to the chess board, but those chess pieces do not attach anything other than themselves to the chess board. In essence, the magnetic chess pieces have a non-magnetic handle portion and a magnetic base. Because of their simplicity and effectiveness, it would be desirable if chess-like pieces, having a non-magnetic handle portion and magnetic base portion, were provided for attaching non-magnetic articles, such as cards and photographs, to a magnetic support.

Still other features would be desirable in a magnetic card display apparatus. For example, often a plurality of cards are displayed, and the cards have a common theme, such as birthday, anniversary, a specific holiday, etc. In this respect, it would be desirable if a magnetic card display apparatus itself could exhibit a decorative theme relating to the common theme of the cards displayed thereon.

Moreover, as indicated above, themes for cards can vary from occasion to occasion. In this respect, it would be desirable in the decorative theme of a magnetic card display apparatus could be easily varied to accommodate varied changes in the themes of the cards displayed thereon.

Thus, while the foregoing body of prior art indicates it to be well known to use magnetic display devices, the prior art described above does not teach or suggest a magnetic card display apparatus which has the following combination of desirable features: (1) provides a card holding device that retains the cards on the device with magnets; (2) does not require a magnetic frame to fit properly around a card or photograph that is displayed; (3) does not require a magnetic frame at all to attach a card or photograph to a complementary magnetic support; (4) has no need for a magnetic bracket to be provided for holding three-dimensional articles, such as earrings, in a spaced relation away from a magnetic support surface; (5) has no need for an article-holding portion to require three right-angled bends to space the portion away from the magnetic support surface; (6) easily permits interchange or substitution of cards or photographs that are displayed on a magnetic support with other cards or photographs to be displayed on the magnetic support; (7) permits a magnetic card display apparatus itself to exhibit a decorative theme relating to a common theme of the cards displayed thereon; and (8) permits a decorative theme of a magnetic card display apparatus to be easily varied to accommodate varied changes in the themes of the cards displayed thereon. The foregoing desired characteristics are provided by the unique magnetic card display apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a display apparatus which includes a magnetic board unit which includes a non-magnetic board base and a magnetic layer or ferro-magnetic layer attached to the non-magnetic board base. Magnetic clamp units are provided for attaching non-magnetic articles to the magnetic board unit. Each of the magnetic clamp units includes a magnetic base portion, and a non-magnetic handle portion that is connected to the magnetic base portion.

A decorative layer can be attached to the magnetic board unit. The magnetic board unit can have an overall decorative shape. The overall decorative shape can be that of a snowman.

A removable and replaceable decoration can be provided, and decoration attachment means can be provided for attaching the removable and replaceable decoration to the magnetic board unit. The decoration attachment means can include a first hook or loop connector attached to the removable and replaceable decoration and a complementary second hook or loop connector attached to the magnetic board unit.

A stand can be provided for supporting the magnetic board unit. Preferably, the stand includes a first stand side, a second stand side, and side-to-side hinge means for connecting the second stand side to the first stand side. Preferably, each of the first and second stand sides includes a stand distal foot portion and a stand notch portion located between the stand distal foot portion and side back edges of the stand sides. Preferably, each of the stand notch portions is spaced from the stand side back edges by a notch-to-back distance. Preferably, each of the stand sides includes a stand side front edge which slopes rearwardly from the stand notch portions to the stand side back edges.

A slip over cover can be provided for slipping over the magnetic board unit, such that the slip over cover is located between the magnetic board unit and the magnetic clamp units. More specifically, the slip over cover includes a magnetic-board-unit-reception opening. A first cover hook or loop material is connected to a first side of the slip over cover adjacent to the magnetic-board-unit-reception opening. A cover flap is connected to a second side of the slip over cover adjacent to the magnetic-board-unit-reception opening. A second cover hook or loop material is connected to the cover flap, such that when the cover flap covers the magnetic-board-unit-reception opening, the second cover hook or loop material engages the first cover hook or loop material. The slip over cover can have a decorative theme.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnetic card display apparatus which has all of the advantages of the prior art and none of the disadvantages.

It is another object of the present invention to provide a new and improved magnetic card display apparatus which may be easily and efficiently manufactured and marketed.

It is a further object of the present invention to provide a new and improved magnetic card display apparatus which is of durable and reliable construction.

Still yet a further object of the present invention is to provide a new and improved magnetic card display apparatus which provides a card holding device that retains the cards on the device with magnets.

Still another object of the present invention is to provide a new and improved magnetic card display apparatus that does not require a magnetic frame to fit properly around a card or photograph that is displayed.

Yet another object of the present invention is to provide a new and improved magnetic card display apparatus which does not require a magnetic frame at all to attach a card or photograph to a complementary magnetic support.

Even another object of the present invention is to provide a new and improved magnetic card display apparatus that has no need for a magnetic bracket to be provided for holding three-dimensional articles, such as earrings, in a spaced relation away from a magnetic support surface.

Still a further object of the present invention is to provide a new and improved magnetic card display apparatus which has no need for an article-holding portion to require three right-angled bends to space the portion away from the magnetic support surface.

Yet another object of the present invention is to provide a new and improved magnetic card display apparatus that easily permits interchange or substitution of cards or photographs that are displayed on a magnetic support with other cards or photographs to be displayed on the magnetic support.

Still another object of the present invention is to provide a new and improved magnetic card display apparatus which permits a magnetic card display apparatus itself to exhibit a decorative theme relating to a common theme of the cards displayed thereon.

Yet another object of the present invention is to provide a new and improved magnetic card display apparatus that permits a decorative theme of a magnetic card display apparatus to be easily varied to accommodate varied changes in the themes of the cards displayed thereon.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a front view of the embodiment of the magnetic card display apparatus of the invention shown in FIG. 1, wherein the greeting cards and the magnetic pawns have been removed.

FIG. 4 is an enlarged, partial cross-sectional view of the embodiment of the invention shown in FIG. 3 taken along line 4-4 thereof.

FIG. 5 shows a plurality of magnetic pawns used with invention.

FIG. 6 is a front view of a second embodiment of the invention which includes two display units.

FIG. 7 is a front view of a third embodiment of the invention which includes three display units.

FIG. 10 is a front view of another embodiment of the invention in which a stand is used for supporting the magnetic board unit and in which a slip over cover is used to enclose the magnetic board unit.

FIG. 11 is a top view of the embodiment of the invention shown in FIG. 10, taken along line 11-11 thereof.

DESCRIPTION OF THE PREFERRED EMBODIMENT

Figure 1:
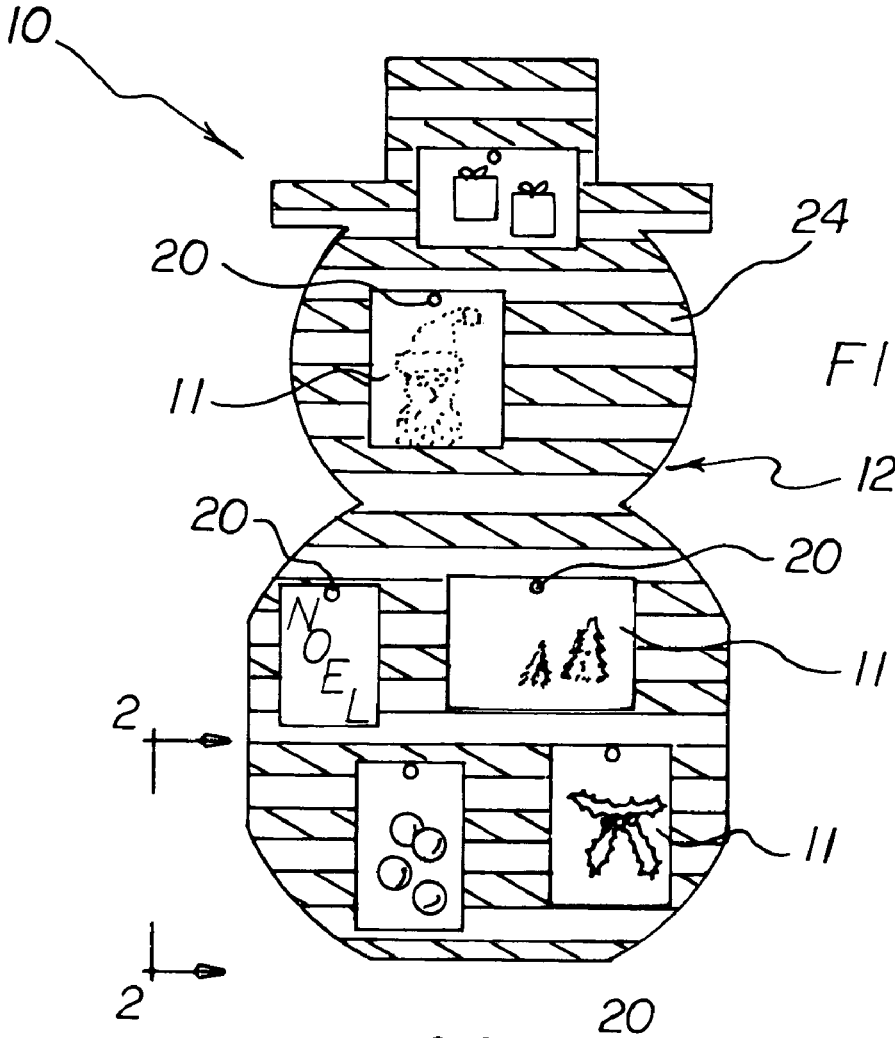
FIG. 1 is a front view showing a first embodiment of the magnetic card display apparatus of the invention, wherein a plurality of greeting cards are attached thereto with a plurality of magnetic pawns.
Figure 2:
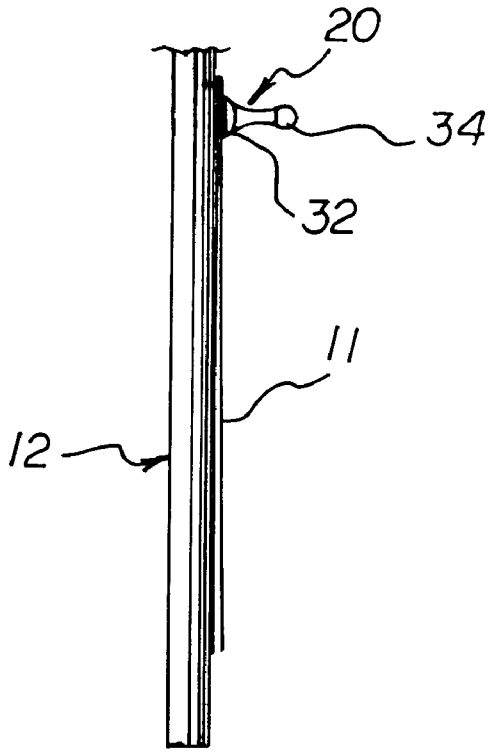
FIG. 2 is an enlarged, partial edge view of the embodiment of the magnetic card display apparatus shown in FIG. 1 taken along line 2-2 of FIG. 1.

With reference to the drawings, a new and improved magnetic card display apparatus embodying the principles and concepts of the present invention will be described.

Turning to FIGS. 1-5, there is shown a first embodiment of the magnetic card display apparatus of the invention generally designated by reference numeral 10. In the first embodiment, magnetic card display apparatus 10 includes a magnetic board unit 12 which includes a board base 14 and a magnetic layer 16 attached to the board base 14. Magnetic clamp units 20 are provided for attaching non-magnetic articles to the magnetic board unit 12. Preferably, a decorative layer 24 is attached to the magnetic layer 16.

The board base 14 can be made from a foam board. The foam board can have any suitable dimensions, such as 20 inches by 30 inches. A smaller version, designated a "junior" version can be 11 inches by 14 inches. The magnetic layer 16 can be 60 mil thick and can be 20 inches by 30 inches. The magnetic layer 16 can be glued to the board base 14. The decorative layer 24 can be glued to the magnetic layer 16. The decorative layer 24 can be formed of a variety of patterns. The drawings show the decorative layer 24 to be in the form of stripes adhered to the magnetic layer 16. The decorative stripes 24 can be in the form of decorative wrapping paper, such as the kind used for wrapping gifts. Alternatively, the decorative layer 24 can be a continuous layer of material such as fabric, for example, that completely covers the magnetic layer 16. The decorative layer 24 can be in the form of themed decorations such as themes for birthdays, Christmas, Hanukkah, anniversaries, Thanksgiving, and Easter. The magnetic board unit 12 can have an overall decorative shape, such as, for example, that of a snowman.

Preferably, each of the magnetic clamp units 20 includes a magnetic base portion 32, and a handle portion 34 is connected to the magnetic base portion 32. The magnetic clamp units 20 can be in the form of magnetic pawns, such as pawns used in a magnetic chess game. The magnetic pawns can be provided in a variety of colors. Alternatively, the magnetic clamp units 20 can be in the form of magnet disks with mini clothespins glued to them.

To use the magnetic display apparatus 10 of the invention, a person can mount and display a plurality of greeting cards on the apparatus without ruining the cards with pin holes. It is well known that greeting cards are generally made from paper or plastic or other non-magnetic material. As such, the greeting cards cannot be conventionally mounted on magnetic surface. The person simply places a greeting card 11 on the magnetic board unit 12 with one hand, and with the other hand, the person places a magnetic clamp unit 20 on top of the greeting card 11, thereby clamping the greeting card 11 between the magnetic clamp unit 20 and the magnetic board unit 12 by means of the magnetic attractive force between the magnetic clamp unit 20 and the magnetic board unit 12.

With another embodiment of the invention, removable and replaceable decoration 22 is provided, and attachment means are provided for attaching the removable and replaceable decoration 22 to the magnetic board unit 12. Preferably, the attachment means include a first hook or loop connector 26 attached to the removable and replaceable decoration 22, and a complementary second hook or loop connector 28 is attached to the magnetic board unit 12. The first hook or loop connector 26 and the second hook or loop connector 28 can be made from well known VELCRO™ material.

FIG. 6 shows a second embodiment 30 of the invention which includes two display units.

FIG. 7 shows a third embodiment 40 of the invention which includes three display units.

Figure 8:
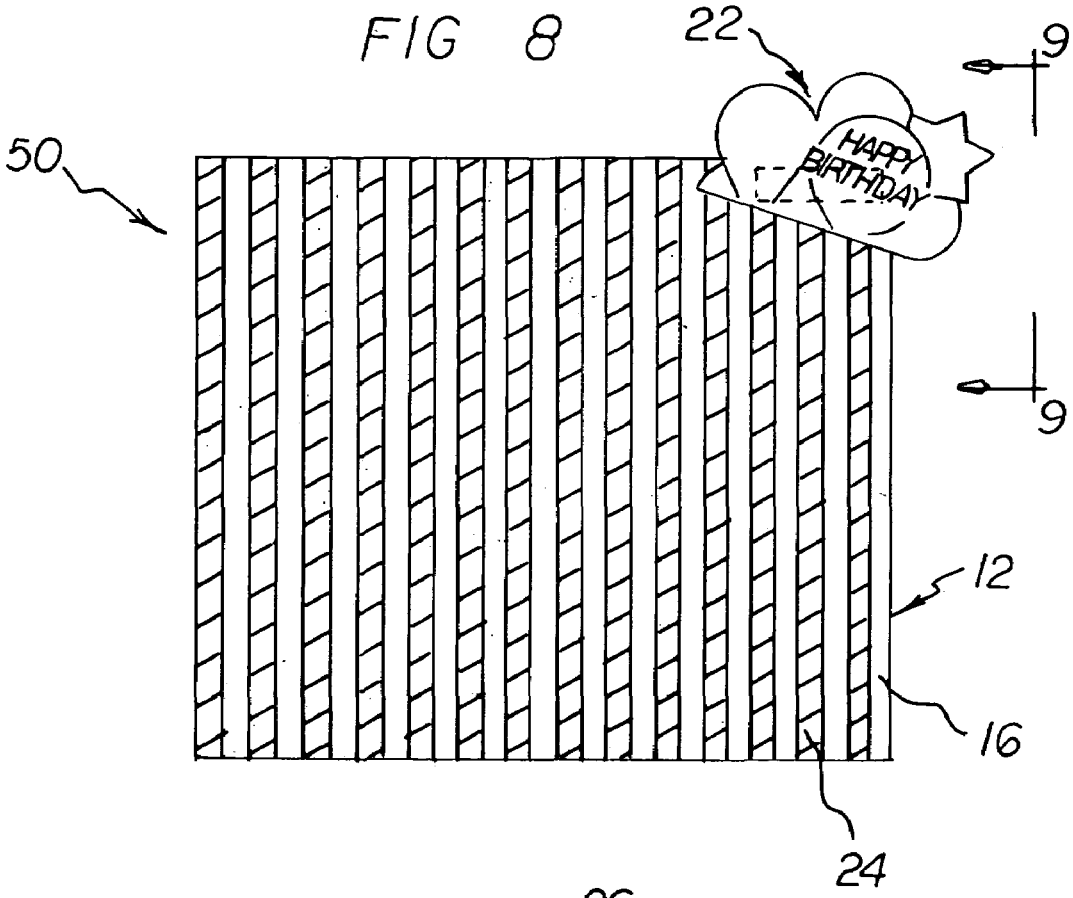
FIG. 8 is a front view of a fourth embodiment of the invention which includes a removable and replaceable decoration for a magnetic card display apparatus.
Figure 9:
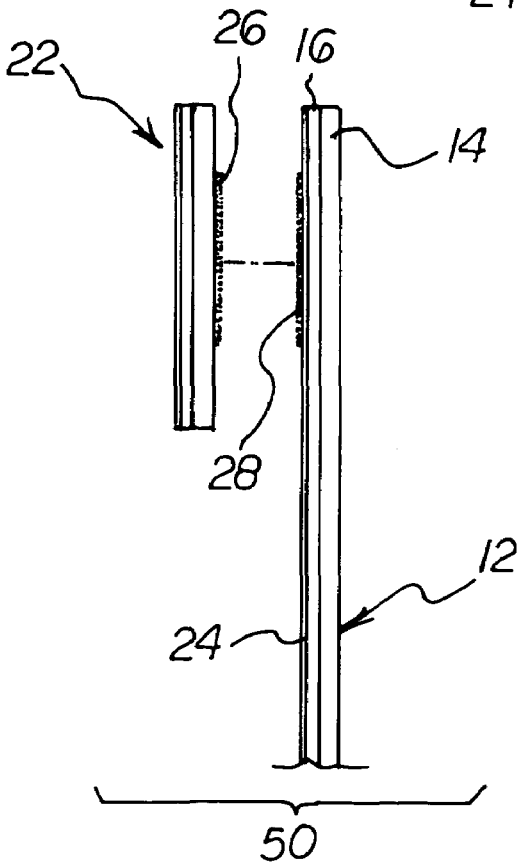
FIG. 9 is a partial side view and partially exploded view of the embodiment of the invention shown in FIG. 8, taken along line 9-9 thereof.

FIG. 8 shows a fourth embodiment of the invention which includes a removable and replaceable decoration 22 for a magnetic card display apparatus.

FIGS. 10, 11, 12, and 14 illustrate another mostly preferred embodiment of the invention in which a stand 46 is provided for supporting the magnetic board unit 12 and the greeting cards 11 supported thereon. More specifically, the stand 46 includes a first stand side 48 and a second stand side 52, wherein the two stand sides are connected together by means of side-to-side hinges 54.

Figure 12:
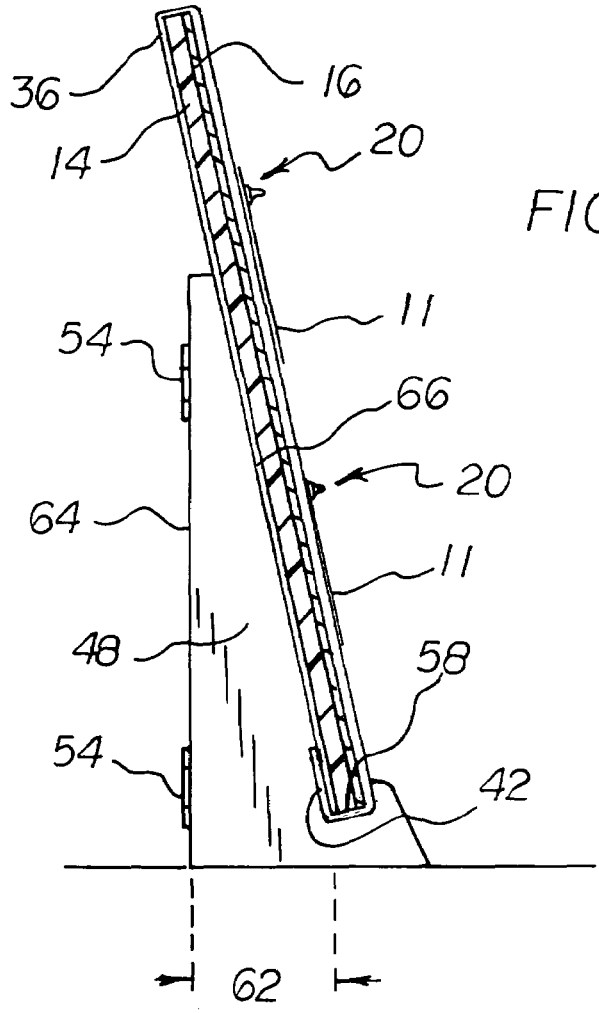
FIG. 12 is a cross-sectional view of the embodiment of the invention shown in FIG. 10, taken along line 12-12 thereof.

Preferably, each of the respective stand sides includes a stand distal foot portion 56 and a stand notch portion 58 located behind the stand distal foot portion 56. As shown in FIG. 12, the stand notch portion 58 is spaced away from the stand side back edges 64 by a notch-to-back distance 62. The notch-to-back distance 62 provides that the stand side front edge 66 slopes rearwardly from the stand notch portion 58 to the stand side back edges 64.

In addition, another feature of the embodiment of the invention shown in FIGS. 10-14 is the presence of a slip over cover 36 which is slipped over the magnetic board unit 12 prior to affixing the greeting cards 11 onto the apparatus using the magnetic clamp units 20. Different slip over covers 36 can have different decorative themes. By readily replacing one slip over cover 36 with another slip over cover 36, a different decorative theme for the magnetic card display apparatus of the invention can be obtained.

More specifically, with respect to the slip over cover 36, the bottom portion of one side of the slip over cover 36, at the magnetic-board-unit-reception opening 70 of the slip over cover 36, includes a first cover strip of hook or loop material 38. In addition, the slip over cover 36 includes a cover flap 42 that has a second cover strip of hook or loop material 44 located thereon. Once the magnetic board unit 12 is inside the slip over cover 36, the cover flap 42 is swung around the magnetic-board-unit-reception opening 70, and the second cover hook or loop material 44 is engaged with the first cover hook or loop material 38 to secure the magnetic board unit 12 inside the slip over cover 36.

Figure 13:
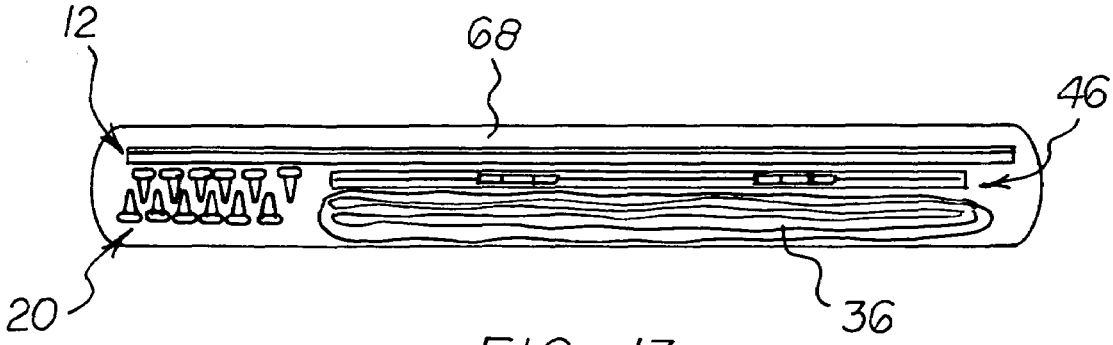
FIG. 13 is a cross-sectional view of an embodiment of the invention which includes a carrying case for carrying a magnetic board unit, a stand, a slip over cover, and a plurality of magnetic clamp units.
Figure 14:
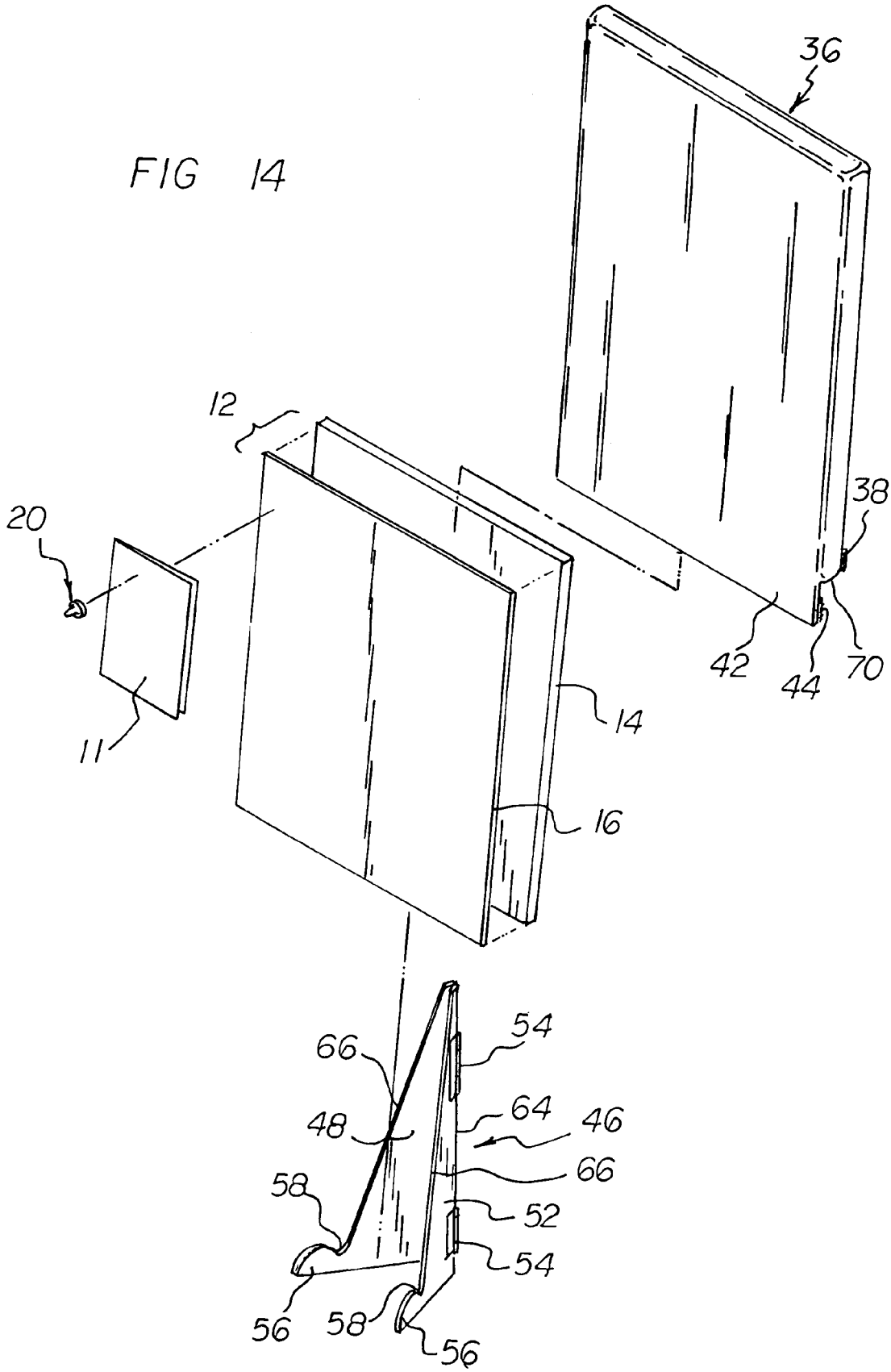
FIG. 14 is an exploded perspective view of the embodiment of the invention shown in FIG. 12.

As shown in FIG. 13, a carrying case 68, such as a plastic bag or reclosable box or like container, can be provided for storing the magnetic board unit 12, the magnetic clamp units 20, the greeting cards 11, the removable and replaceable decoration 22, the slip over cover 36, and the stand 46 when display of the greeting cards 11 is not desired.

Figures 15, 16:
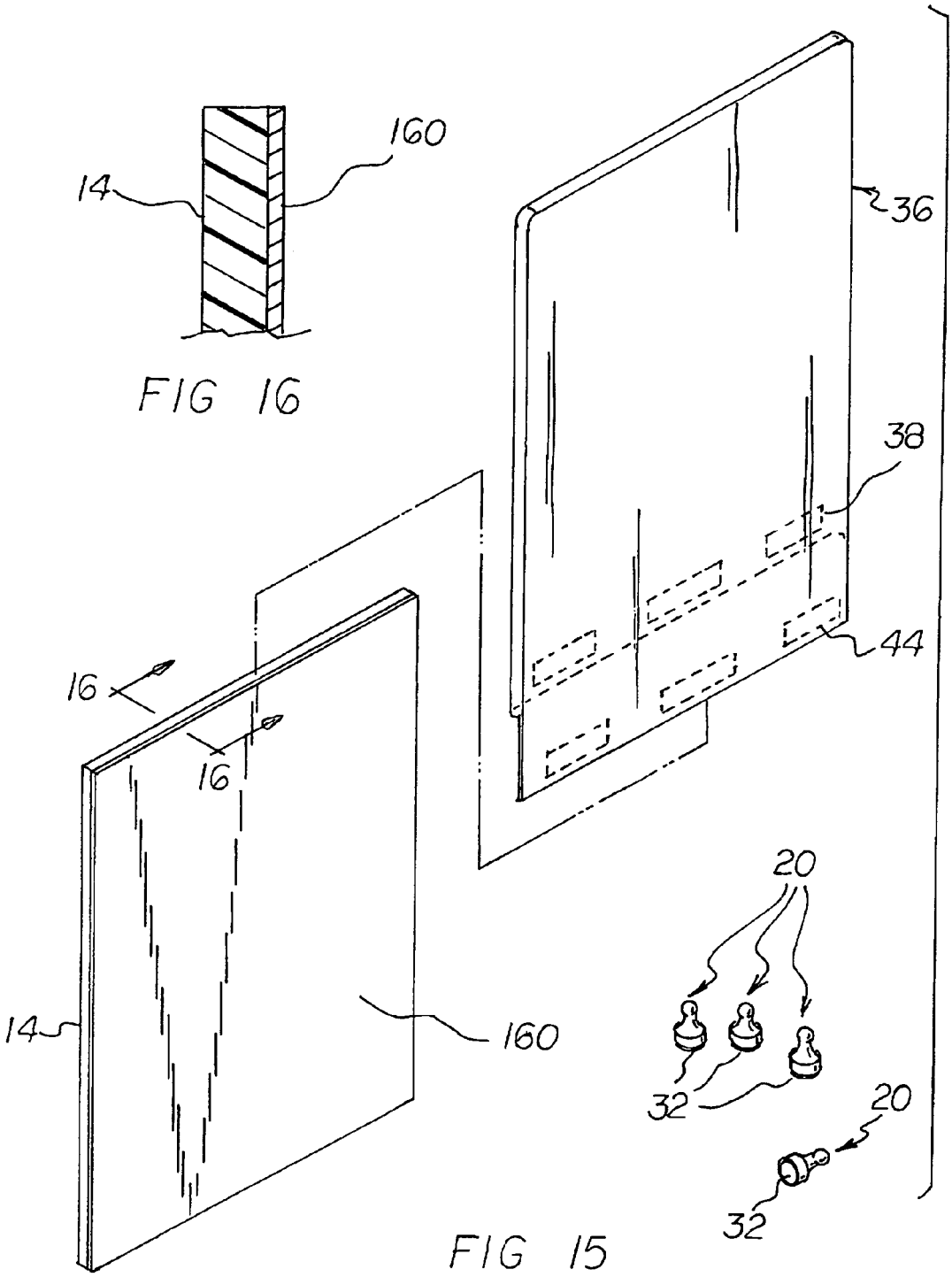
FIG. 15 is a perspective view showing an alternatively preferred embodiment of the magnetic board of the assembly shown in FIG. 14.
FIG. 16 is an enlarged cross-sectional view of a fragment of the alternatively preferred embodiment of the invention shown in FIG. 15.

It will be appreciated that instead of employing the magnetic layer 16 attached to the foam board base 14 as the magnet attracting layer, a layer 160 of ferro-magnetic material such as galvanized sheet metal, for example, may be employed as well. Such an alternatively preferred arrangement is shown in FIGS. 15 and 16 where like reference signs represent like parts. The magnetic base portion 32 of each clamping member 20 will form a magnetic circuit through the ferro-magnetic layer 160 as will be understood by those skilled in the art. Hence, the term "magnet attracting layer" as used herein or in the annexed claims shall be understood to include either or both magnet layer 16 or ferro-magnetic material layer 160.

The removable and replaceable decoration 22 can have a theme, such as, for example, "Happy Birthday".

The components of the magnetic card display apparatus of the invention can be made from inexpensive and durable non-magnetic and magnetic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved magnetic card display apparatus that is low in cost, relatively simple in design and operation, and which may advantageously be used to provide a card holding device that retains the cards on the device with magnets. With the invention, a magnetic card display apparatus is provided which does not require a magnetic frame to fit properly around a card or photograph that is displayed. With the invention, a magnetic card display apparatus is provided which does not require a magnetic frame at all to attach a card or photograph to a complementary magnetic support. With the invention, a magnetic card display apparatus is provided which has no need for a magnetic bracket to be provided for holding three-dimensional articles, such as earrings, in a spaced relation away from a magnetic support surface. With the invention, a magnetic card display apparatus is provided which has no need for an article-holding portion to require three right-angled bends to space the portion away from the magnetic support surface. With the invention, a magnetic card display apparatus is provided which easily permits interchange or substitution of cards or photographs that are displayed on a magnetic support with other cards or photographs to be displayed on the magnetic support. With the invention, a magnetic card display apparatus is provided which permits a magnetic card display apparatus itself to exhibit a decorative theme relating to a common theme of the cards displayed thereon. With the invention, a magnetic card display apparatus is provided which permits a decorative theme of a magnetic card display apparatus to be easily varied to accommodate varied changes in the themes of the cards displayed thereon.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

The invention claimed is:

1. A magnetic display apparatus, comprising:

a magnetic board unit which includes a non-magnetic board base and a magnet attracting layer attached to said non-magnetic board base, and magnetic clamp units for attaching non-magnetic articles to said magnetic board unit, wherein each of said magnetic clamp units includes a magnetic base portion, and a non-magnetic handle portion connected to said magnetic base portion, further including:

a slip over cover for slipping over said magnetic board unit, such that said slip over cover is located between said magnetic board unit and said magnetic clamp units, wherein said slip over cover includes:

a magnetic-board-unit-reception opening, a first cover hook or loop material connected to a first side of said slip over cover adjacent to said magnetic-board-unit-reception opening, a cover flap connected to a second side of said slip over cover adjacent to said magnetic-board-unit-reception opening, and a second cover hook or loop material connected to said cover flap, such that when said cover flap covers said magnetic-board-unit-reception opening, said second cover hook or loop material engages said first cover hook or loop material.

2. The apparatus of claim 1, further including:

a decorative layer on said magnetic layer.

3. The apparatus of claim 1 wherein said magnetic board unit has an overall decorative shape.

4. The apparatus of claim 1, further including:

a stand for supporting said magnetic board unit.

5. The apparatus of claim 4 wherein said stand includes:

a first stand side, a second stand side, and side-to-side hinge means for connecting said second stand side to said first stand side, wherein each of said first and second stand sides includes a stand distal foot portion and a stand notch portion located between said stand distal foot portion and side back edges of said stand sides.

6. The apparatus of claim 4 wherein:

each of said stand notch portions is spaced from said stand side back edges by a notch-to-back distance, and each of said stand sides includes a stand side front edge which slopes rearwardly from said stand notch portions to the stand side back edges.

7. The apparatus of claim 1 wherein said slip over cover has a decorative theme.

8. The apparatus of claim 1 wherein said magnet attracting layer is a layer of magnetic material.

9. The apparatus of claim 1 wherein said magnet attracting layer is a layer of ferro-magnetic material.

10. The apparatus of claim 9 wherein said layer of ferro-magnetic material comprises galvanized metal.

* * * * *